United States Patent [19]

Foss et al.

[11] 4,274,353

[45] Jun. 23, 1981

[54] ACOUSTIC IMAGING SYSTEM FOR WIRE GUIDED TORPEDO

[75] Inventors: Rene N. Foss, Seattle; Sidney Levine, Bothell, both of Wash.

[73] Assignee: The United States of America as represented by the Secretary of the Navy, Washington, D.C.

[21] Appl. No.: 694,025

[22] Filed: Dec. 22, 1967

[51] Int. Cl.[3] ..... F42B 19/10; F41G 7/02

[52] U.S. Cl. ..... 114/21 A; 367/119

[58] Field of Search ..... 114/20, 21, 23; 340/6, 340/5

[56] References Cited

U.S. PATENT DOCUMENTS

| | | | |
|---|---|---|---|
| 2,420,676 | 5/1947 | Peterson | 114/23 |
| 3,278,891 | 10/1966 | Cowdery | 367/119 |

*Primary Examiner*—David H. Brown

*Attorney, Agent, or Firm*—R. S. Sciascia; Sol Sheinbein; Phil Schneider

[57] ABSTRACT

An acoustic imaging system for a wire guided torpedo having an array of transducers arranged in the nose of a torpedo to receive acoustic signals. A spherical acoustic lens focuses the signals on the array of transducers. The outputs of the transducers are amplified, integrated, detected and passed to a set of gates which are sampled sequentially, and the outputs of the gates are passed by a wire to the launching vehicle.

7 Claims, 2 Drawing Figures

ACOUSTIC IMAGING SYSTEM FOR WIRE GUIDED TORPEDO

BACKGROUND OF THE INVENTION

1. Field of the Invention

The present invention relates to an acoustic imaging system for a wire guided torpedo and, more particularly, to a device mounted in the nose of a torpedo for discerning the location of a target by detecting acoustic energy emanating from the target. The invention provides means for processing target detection information and transmitting it to the launching vehicle.

2. Description of the Prior Art

In the field of target detection devices mounted on torpedoes, it has been the general practice to employ scanning techniques. Such devices scan either horizontally or vertically and detect acoustic energy from any source in the direction of scan. The energy is usually transmitted to an integrator which generates an output which is the function of the time displacement during which the energy was detected. If the source of energy is a constant source such as the screws of a target ship, the integrator indicates a continuous source of energy which can be deemed to be a target. If the source of energy is merely a transient signal, the magnitude of the output of the integrator is relatively small and the source of acoustic energy can generally be disregarded.

These systems have proved to be unsatisfactory in view of the complex equipment required for scanning. In addition, in order to enable the system to scan effectively, the integration time must necessarily be relatively small and therefore the probability of mistaking a target for a decoy or other stray acoustic energy is relatively high. In addition, such systems have displayed an inability to discern between decoying countermeasures and a true target, or between surface and bottom reflections and a true target, or the launching vehicle and the target, and at times have actually sought out the launching vehicle.

Several prior art devices have attempted to control the operation of a torpedo by a wire connected between the torpedo and the lauching station. One such device discloses a passive listening system in a torpedo that is anchored under water. The system transmits target noises back to a control station for evaluation so that the release of the torpedo may be controlled from the station. However, once the torpedo is launched, the control wire is unplugged and the launching station loses control over the torpedo.

SUMMARY OF THE INVENTION

The general purpose of this invention is to provide a wire guided torpedo which is capable of detecting targets and of being more accurately controlled than prior art devices. To attain this end the present invention provides a multi-element rectinal system on which incoming acoustic signals are focussed by means of an acoustic lens. The retinal element contains an ordered arrangement of piezoceramic receiving hydrophones, each retinal element position seeing only signals from one direction relative to "dead ahead". The output from each retinal element is amplified through a corresponding amplifier. The output of the amplifiers are then rectified to yield a D.C. level corresponding to a particular input energy level, this D.C. level then being passed to an integrator. The output of each integrator is passed to a gate. The various gates, each corresponding to an individual transducer, are sequentially sampled by a standard sampling device and passed through a conducting wire to a control station which is usually on the launching vehicle, but may be elsewhere. The received signals at the control station are applied to any standard utilization device such as an oscilloscope or other readout device. Each position on the oscilloscope to which the signals are applied corresponds to a particular retinal element which can detect energy from only one direction. The pattern on the oscilloscope screen thus gives an intensity presentation of the noise pattern ahead of the torpedo.

Accordingly, an object of the present invention is to provide means to detect a target.

Another object of the present invention is to provide means capable of being mounted on a torpedo for detecting acoustic energy in either a horizontal or vertical plane.

A further object of the present invention is to provide means to transmit information obtained by a moving vehicle to a launching station.

Still another object of the present invention is to provide means to discern between energy received from a target and energy received from an irrelevant source.

Other objects, advantages and novel features of the invention will become apparent from the following detailed description of the invention when considered in conjunction with the accompanying drawings in which like reference numerals designate like parts throughout the figures thereof.

DESCRIPTION OF THE PREFERRED EMBODIMENTS

Figure 1:
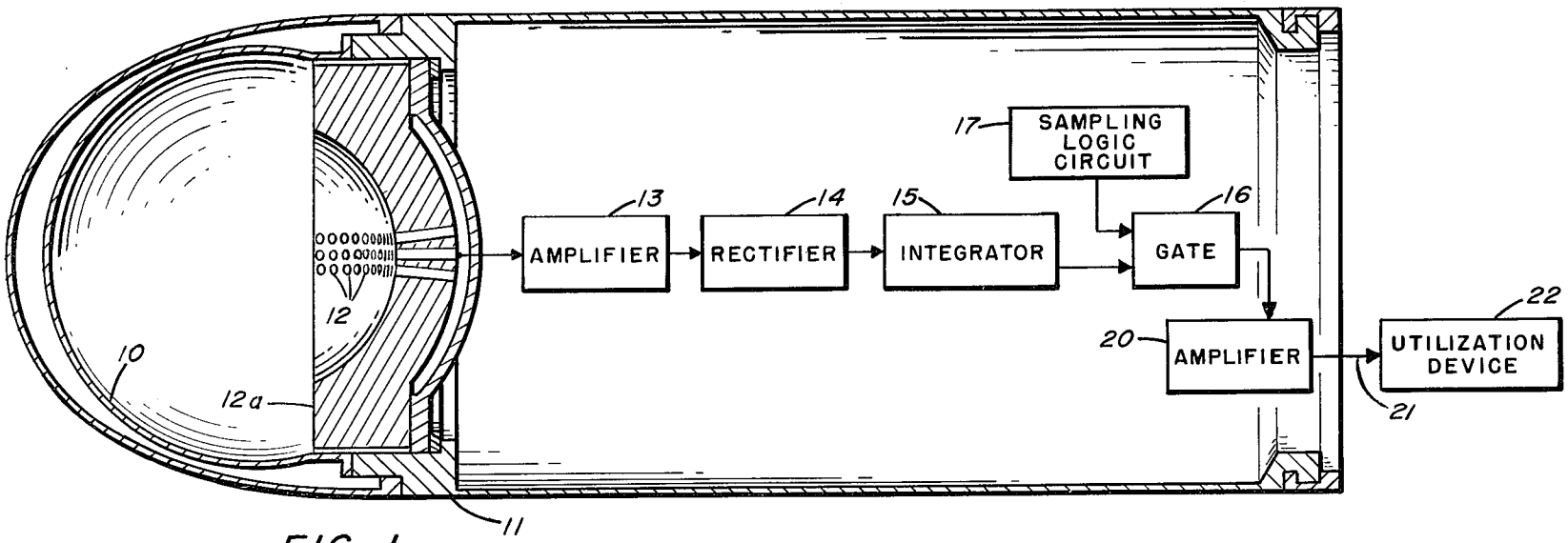
FIG. 1 shows an embodiment of the present invention.
Figure 2:
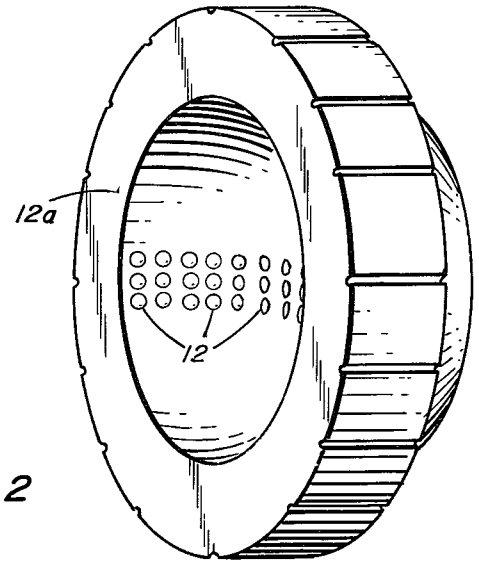
FIG. 2 shows a torpedo with its nose and lens removed to display the retina.

Referring now to FIG. 1 of the drawing, there is shown an acoustic lens 10 mounted in the nose of a torpedo 11. The lens may be any standard acoustic lens and comprises a thin spherical shell with a special fluid inside which focuses rays of sound on the opposite side of the sphere. The paths of sound are traced according to Snell's law and the index of refraction is such that rays of sound are bent to focus on opposite side of the lens. The incoming rays of sound are focused on a multi-element retinal system having a plurality of transducers 12, the transducers being arranged around the inner concave face of a spherical matrix 12A. The transducers 12 may be any standard acoustic transducer such as a piezoceramic receiving hydrophone and the output of each transducer forms a separate channel and is coupled to an individual amplifier 13. The output of each amplifier is then coupled to an associated rectifier 14, the output of each rectifier being coupled to an associated integrator 15 which is in turn coupled to an associated gate circuit 16.

The various gates corresponding to each individual transducer are sampled by a standard sampling logic circuit 17, which may be any standard multiplexer, for example. The outputs of all of the gates are joined together in an amplifier 20, the output of amplifier 20 being coupled to an electrically conducting wire 21. The wire 21 is connected to some utilization device 22, such as a standard oscilloscope, or the like, for displaying target information, or to a computer for storing the information for later usage. The utilization device 22 is usually located aboard the vessel (not shown) from which the torpedo was launched and by study of the target information displayed on the utilization device it can be determined if corrective guidance controls should be sent back to the torpedo to thereby insure its impact with a valid and desired target.

According to the operation of the present invention, acoustic energy lying ahead of the torpedo 11 is focused by lens 10 on the transducer array 12. The transducers 12 convert the acoustic energy to electrical energy and feed the electrical energy to amplifiers 13. The energy is converted from an A.C. level to a D.C. level by rectifier 14, and the output of rectifier 14 is coupled to integrator 15 which contains a capacitive element. The capacitor does not charge up immediately but integrates the output of rectifier 14 with respect to time so that the integrator 15 gives an indication of whether the noise detected is from a steady-state source, which is probably the screws of a target ship, or from a transient or otherwise irrelevant noise source. If the magnitude of the output integrator 15 is relatively great, in all probability the source of noise is the steady-state noise from the screws of the target ship. If the output of integrator 15 is relatively small, in all probability the source is a transient noise source and irrelevant.

The output of integrators 15 are coupled to gates 16 which are sampled sequentially by sampling logic circuitry 17. The outputs from gates 16 are coupled to amplifier 20 which amplfies the signals and passes them along guidance wire 21 to utilizaton device 22 which is on a monitoring station. The utilization device may be mounted on a control station on shore or on board the launching device. The utilization device 22 may be synchronized with the operation of sampling logic circuitry 17 by any standard synchronizing device(not shown).

Thus, it is seen that in view of the fact that each transducer receives acoustic signals from only one direction relative to the forward direction of the torpedo, a picture of all the acoustic signals in the general forward direction of the torpedo may be obtained without the necessity of complex scanning devices. In addition, in view of the fact that each transducer is part of an independent channel, the reliability of the system is increased since the inoperativeness of one transducer does not impair the operativeness of any of the other transducers.

Furthermore, the fact that each trandsducer is capable of looking in the same direction enables the output of the integrator to yield a more meaningful indication as to whether the signal is a steady-state noise source such as the screws of a target ship or some transient irrelevant noise souce. This feature is obviously not present in conventional scanning systems which look in any one given direction for a relatively short dwell time. In such systems, the integration time must necessarily be relatively short and therefore the signal yields a less meaningful indication as to whether the energy detected is from a target or from some irrelevent noise source.

The concept of using a guidance wire enables an observer of the utilization device located in the control station to evaluate the information obtained by the system and to control the operation of the torpedo accordingly, thereby insuring impact on the target. This feature avoids the problem inherent in conventional homing torpedoes of the lack of any means to evaluate the target information if several targets are within acquisition range. In addition, the display of the acoustic pattern detected by the system in a control station enables the observer to discern false targets which arise in shallow water which come about because of reflections from the surface and the bottom.

Obviously many modifications and variations of the present invention are possible in the light of the above teachings.

We claim:

1. A target detector for use with a torpedo comprising:

means mounted in the nose of the torpedo for receiving acoustic energy;

means coupled to said receiving means for converting the acoustic energy into D.C. potential;

means connected to said converting means for sampling the D.C. potential;

utilization means for displaying the sample D.C. potential; and means connecting the sampling means with the utilization means for transmitting the D.C. potential to the utilization means and for receiving guidance signals back from said utilization means to the torpedo.

2. The device as described in claim 1 wherein the receiving means includes a plurality of piezoceramic receiving hydrophones.

3. The device of claim 2 wherein the receiving means further includes an acoustic lens for focusing the received acoustic energy on the hydrophones.

4. The device of claim 3 wherein the converting means includes a plurality of channels containing an amplifier, detector, and integrator, there being a separate channel for each of the plurality of hydrophones.

5. The device of claim 4 wherein the sampling means includes a gate circuit in each of the channels.

6. The device of claim 5 wherein the utilization means includes an oscilloscope remotely located from the torpedo.

7. The device of claim 6 wherein the means connecting the sampling means and the utilization means consists of an electrically conductive wire.

* * * * *